US012691388B2

(12) United States Patent
Prace

(10) Patent No.: US 12,691,388 B2
(45) Date of Patent: Jul. 28, 2026

(54) FORCING MAGIC-TRICK PROP SYSTEM

(71) Applicant: Jeffrey Prace, Highland Park, IL (US)

(72) Inventor: Jeffrey Prace, Highland Park, IL (US)

( * ) Notice: Subject to any disclaimer, the term of this patent is extended or adjusted under 35 U.S.C. 154(b) by 280 days.

(21) Appl. No.: 18/679,848

(22) Filed: May 31, 2024

(65) Prior Publication Data

US 2026/0021426 A1 Jan. 22, 2026

(51) Int. Cl.
*A63J 21/00* (2006.01)

(52) U.S. Cl.
CPC ..... *A63J 21/00* (2013.01)

(58) Field of Classification Search
CPC ..... A63J 21/00; A63J 5/00; A63J 5/02; A63F 1/02; A63F 1/06; A63F 1/062; A63F 1/18; A63F 1/00; A63F 1/04; A63F 1/10; A63F 2001/0491; A63F 2009/0616; A63F 2009/0619; A63F 9/0613
See application file for complete search history.

*Primary Examiner* — Yingchuan Zhang
(74) *Attorney, Agent, or Firm* — Robert Brownstein

(57) ABSTRACT

The invention herein disclosed is a forcing magic-trick prop system that appears to have a random, unpredictable outcome but, in fact, forces a predetermined outcome.

2 Claims, 8 Drawing Sheets

First Card Front Face

First Card Rear Face

Second Card Front Face

Second Card Rear Face

Front Face

Rear Face

FORCING MAGIC-TRICK PROP SYSTEM

TECHNICAL FIELD

The invention is a system for supporting a magic trick by forcing an outcome.

BACKGROUND OF INVENTION

Forcing magic-trick props are systems that create an illusion of randomness while actually forcing a predetermined result.

Essentially, the objective is to make something appear one way while ensuring that it operates in a different and deterministic way.

As an example, a deck of cards presumably containing 52 different and unique cards could be instead made up of 52 identical cards. When the deck, with only the backs exposed, is spread and a participant is asked to pick a card, it will be forced to be one of the 52 identical cards.

A reliable forcing magic-trick prop is one that does what it is designed to do without making the method of operation obvious.

BRIEF DESCRIPTION OF INVENTION

The invention herein disclosed is a forcing magic-trick prop system that forces a predetermined outcome. What appears to be a single card, divided up into several different tabs, each having uniquely different symbols, is actually two different cards. Each card is of equal size, ultimately adhered together to appear as a single card wherein one or more of the tabs will be forced to remain once all other tabs are eliminated using a prescribed procedure.

It appears that each of the tabs, once separated, will have a front face with a unique symbol and a rear face with an opaque color, or some tabs will have an opaque color on both faces. However, the predetermined forcing tabs actually have no opaque-colored face and instead have identical front and back symbols.

This is accomplished by printing identical symbols on both faces of the predetermined forcing tabs and then selectively adhering this card to another card that has designated opaque-colored faces.

The tabs are separated into discrete tabs, gathered into a container, shaken, and tossed onto a flat surface. All tabs will flip like a coin, and any tabs that show an opaque-colored face are eliminated. Ultimately, the predetermined forcing tabs will remain due to having identical symbols on both faces and no opaque-colored face.

DETAILED DESCRIPTION OF INVENTION

Figure 1:
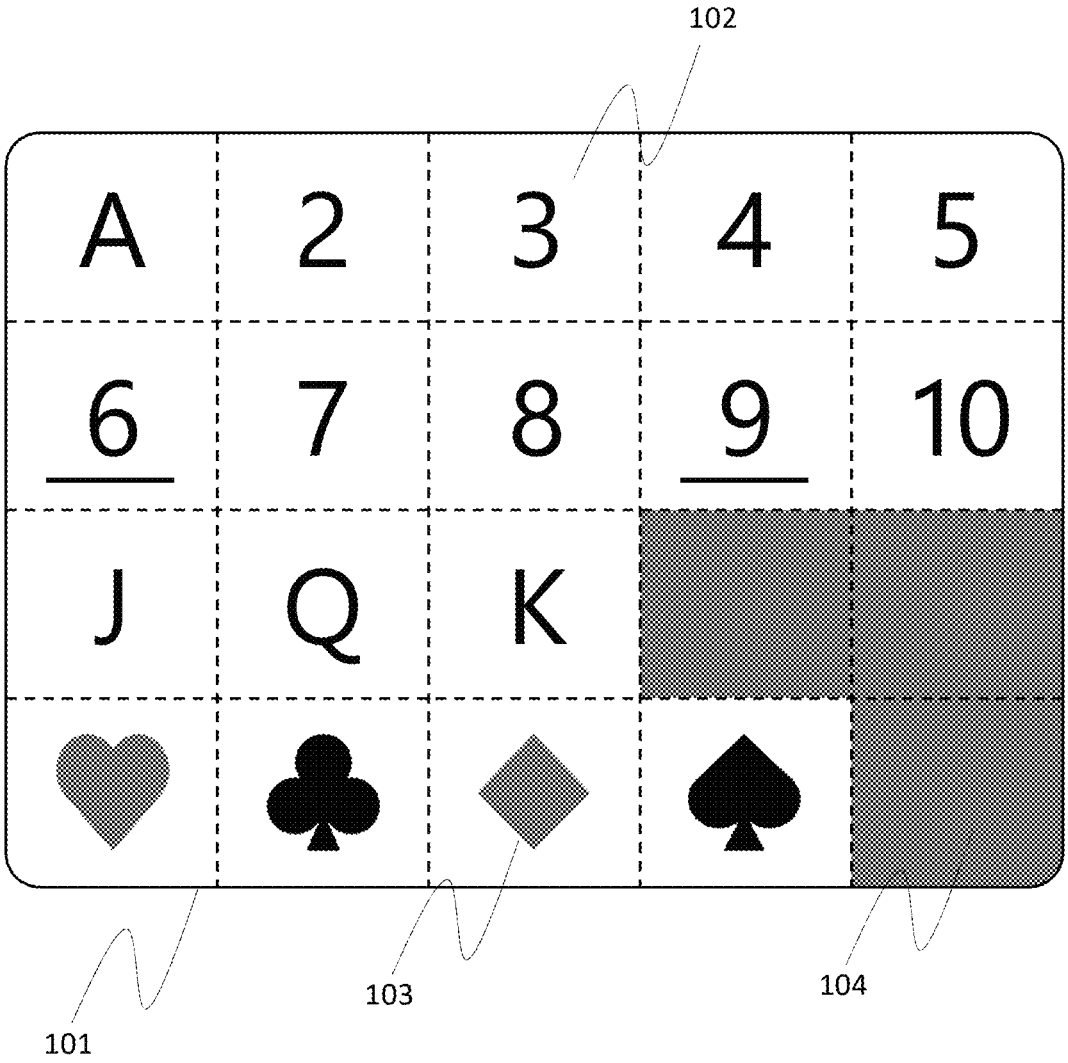
FIG. 1 shows a first card front face with unique symbols and opaque-colored surfaces on several tabs.

As described, a forcing magic-trick prop is designed to produce a predetermined outcome while appearing to be a random, unpredictable outcome.

The forcing magic-trick prop system herein disclosed is exemplified in conjunction with a magic trick in which the tabs of the prop system represent all 52 cards in a standard deck of cards. Once the tabs are separated, they are put in a container, shaken up, and tossed out onto a flat surface. Any tabs showing an opaque-colored face are eliminated. Then, the remaining tabs are placed back into the container and this elimination procedure is repeated until only a predetermined number of tabs have not been eliminated. In this exemplary case, the predetermined number of pieces is two. At the end of the procedure, the tabs with the symbol 9 and the suit symbol for a club will remain.

In this example, only two tabs-one with the symbol 9 and one with the suit symbol for a club—are forced by design. All other tabs will ultimately be eliminated through shaking, tossing, and pulling out the tabs showing an opaque-colored face.

What appears to be a single card with tabs on front and rear faces, and unique symbols on one face and an entirely opaque-colored surface on the opposite face, is illusory.

There initially are, in fact, four different faces on two different cards. A first card has the full complement of unique symbols and opaque-colored surfaces on its front face, and only a selected one or more symbols on its rear face, located on the backside of the tab having the same symbol on the front face. Thus, in this example, the symbol 9 and the suit symbol for a club are displayed on both faces of the first card and are the predetermined forcing tabs.

A second card, with identical sized and shaped tabs as the first card, has a front face with selected opaque-colored tabs that correspond with the predetermined forcing tabs on the first card's front face, and a rear face that is entirely opaque colored.

Adhesive is applied to the rear face of the first card on all tabs except for the predetermined forcing tabs.

The two cards are arranged such that the rear face of the first card is placed over the front face of the second card, with outer edges coinciding, and the two cards are pressed together. This results in what appears to be a single card with a rear face of tabs with opaque-colored surfaces and a front face of tabs with printed symbols and opaque-colored surfaces.

When this card is separated into discrete tabs, it will appear that each tab has a symbol on the front face and an opaque-colored surface on the rear face, or opaque-colored surfaces on both faces. These tabs are then placed in a container, shaken, and tossed onto a flat surface. All tabs exhibiting a face with an opaque-colored surface are removed from the tabs group. The sorting, tossing, and eliminating continue until only a predetermined number of tabs have not been eliminated.

To the observer, it appears to be a random selection, but it was predetermined that only the tabs with the symbol 9 and the suit symbol for a club would remain.

That is because, when separated, the tabs with the symbol 9 and the suit symbol for a club do not have an opaque-colored face. These predetermined forcing tabs have identical symbols on both sides due to not being coated with adhesive. With repeated tossing and elimination, only these two tabs will remain.

The following descriptions and drawings are meant to be exemplary and should not be read as limiting the claim scope to these specifics.

FIG. 1 shows the front face of the first card (101). In this example, it is divided into four rows and five columns. Standard playing cards have 13 unique number/royalty symbols (102) and four unique suits (103). Thus, there would be 17 of these 20 tabs that represent all 52 cards in a standard deck. Three of the tabs (104) are shown as opaque-colored surfaces instead.

Figure 2:
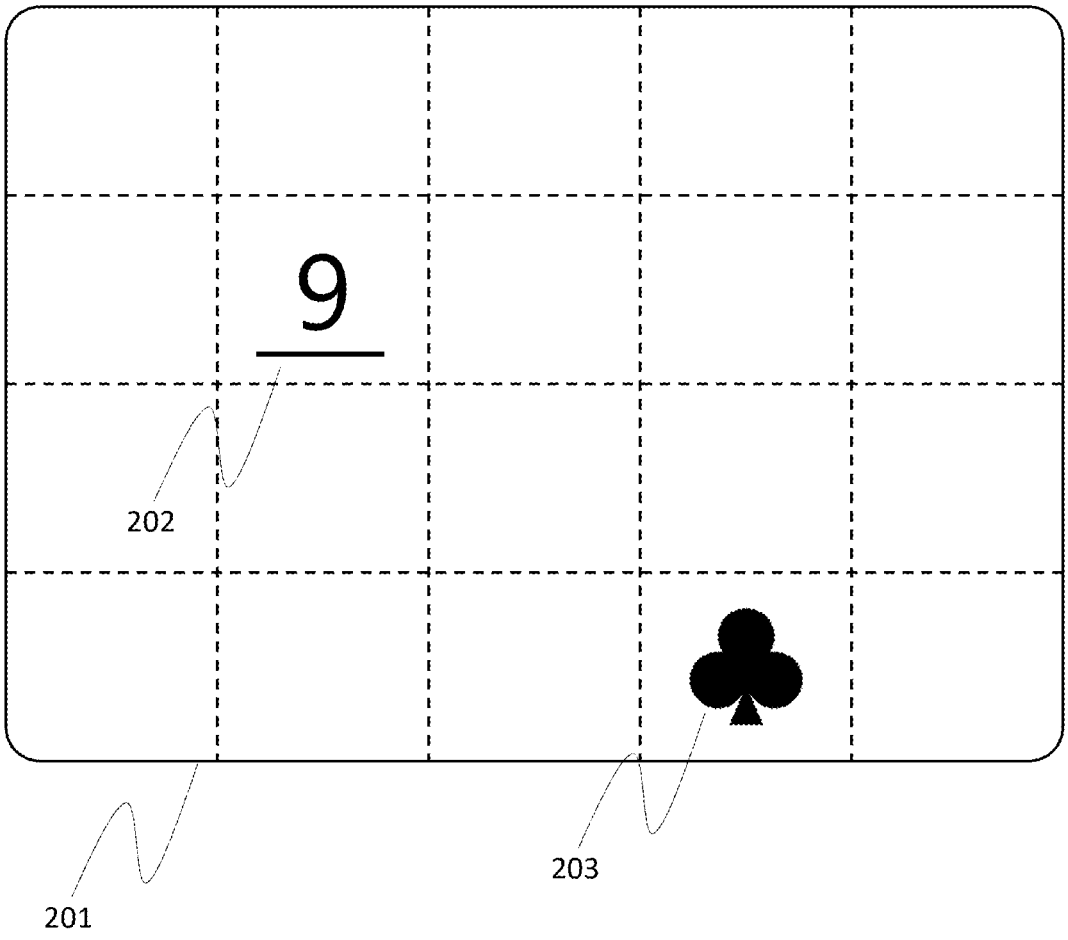
FIG. 2 shows a first card rear face with only one or more symbols printed on the opposite side of the tab having the same symbol as on the tab's front face. Tabs with identical symbols on both faces are the predetermined forcing tabs.

FIG. 2 shows the rear face of the first card (201). All of the tabs are blank except, in this example, the symbol 9 tab (202) and the suit symbol for a club tab (203).

Figure 3:
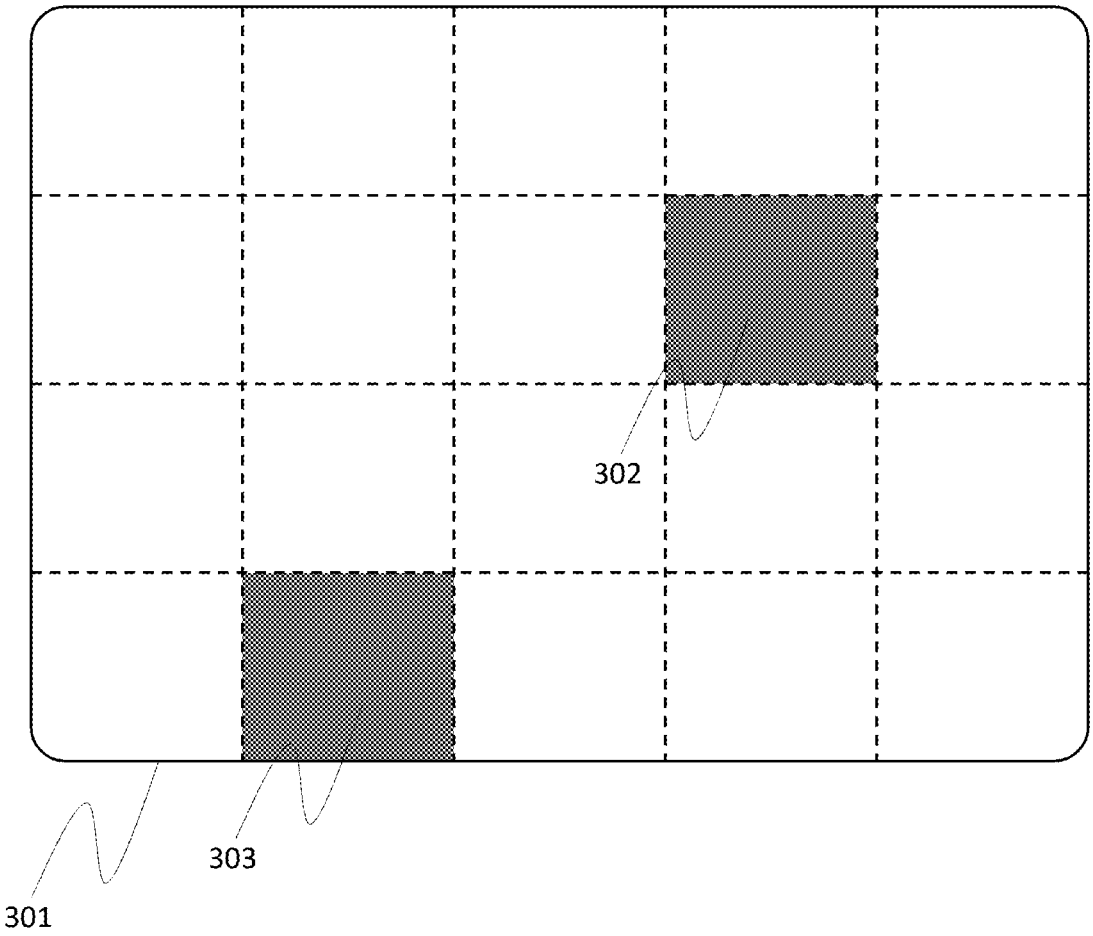
FIG. 3 shows a second card front face with opaque-colored tabs that correspond with the location of the predetermined forcing tabs on the first card's front face.

FIG. 3 shows the front face of the second card (301). It has opaque-colored surfaces that align with the location of the symbol 9 tab on the first card's front face (302) and the suit symbol for a club tab on the first card's front face (303). The card is identical in size to the first card and its rows and columns are identical in size and shape to the first card.

Figure 4:
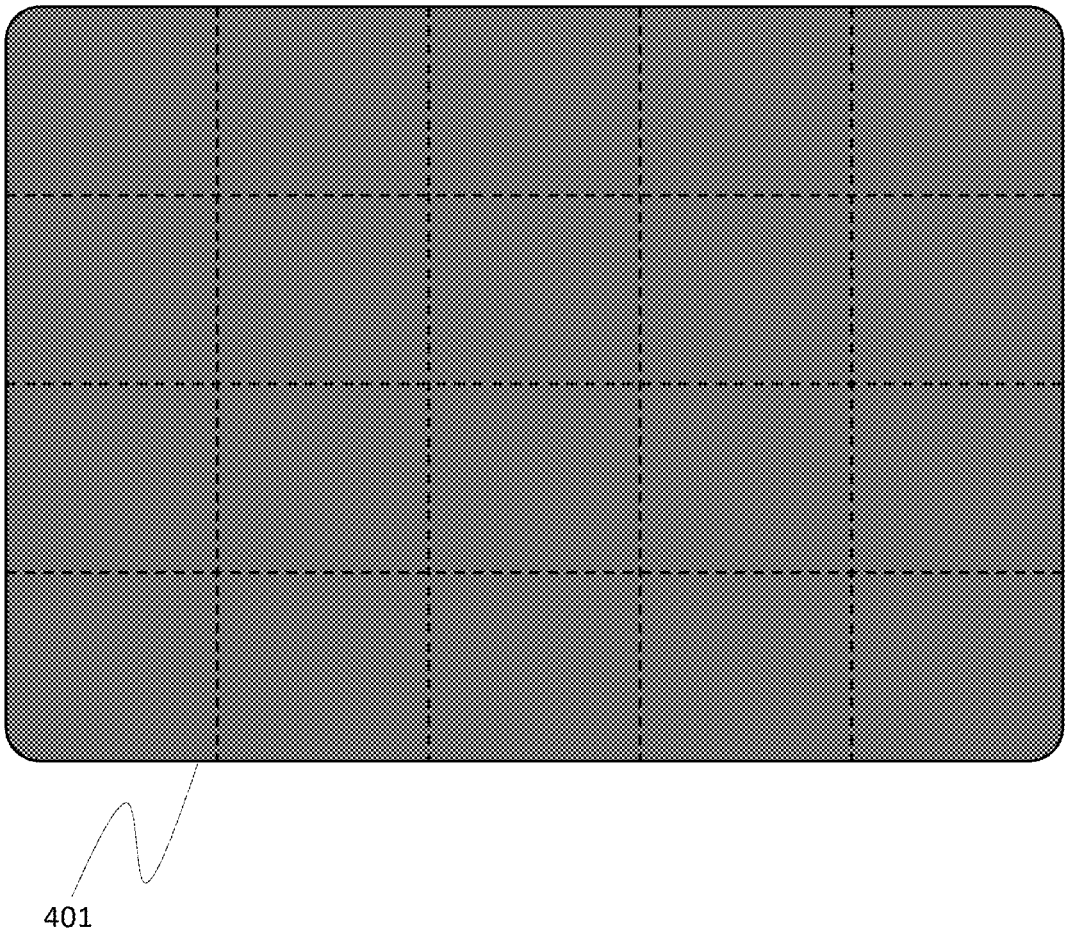
FIG. 4 shows a second card rear face that is entirely opaque colored.

FIG. 4 shows the rear face of the second card (401) with an entirely opaque-colored surface.

Figure 5:
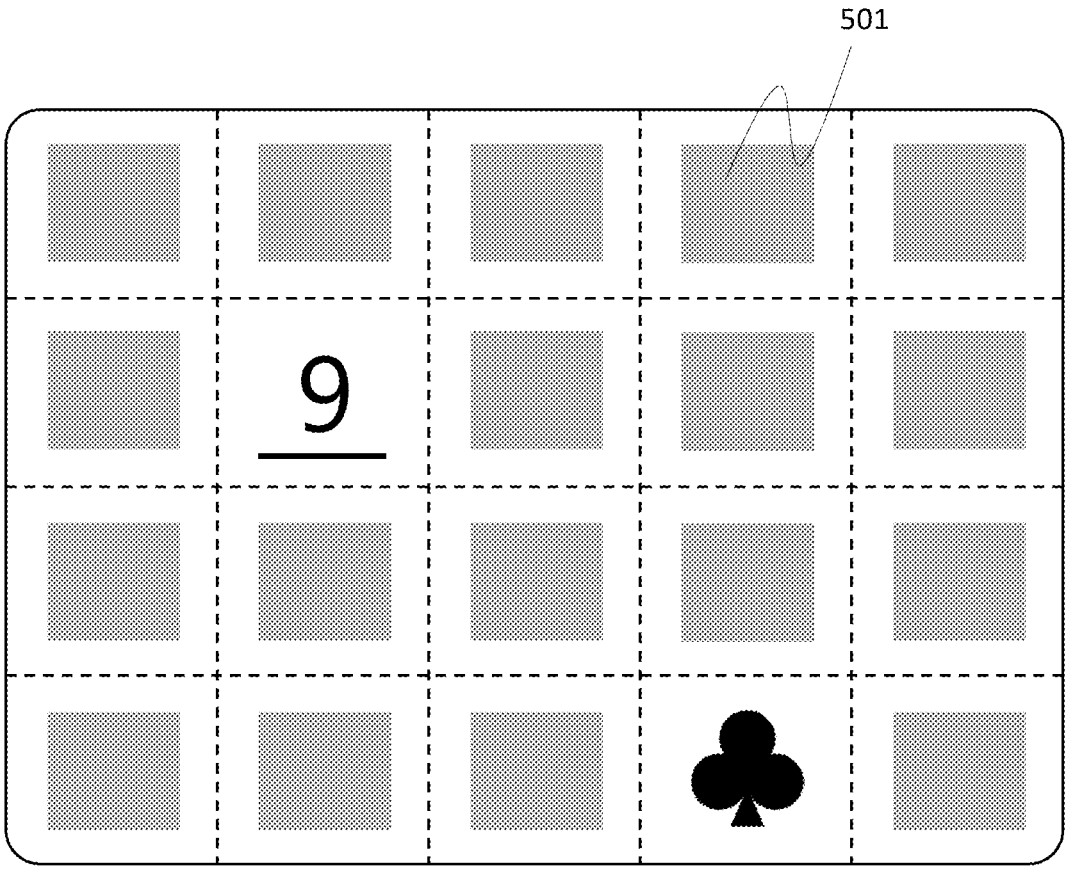
FIG. 5 shows the rear face of the first card where adhesive is applied to all tabs except for the one or more predetermined forcing tabs.

FIG. 5 shows the rear face of the first card is selectively coated with adhesive (501) except for the tabs having the symbol 9 and the suit symbol for a club.

Figure 6:
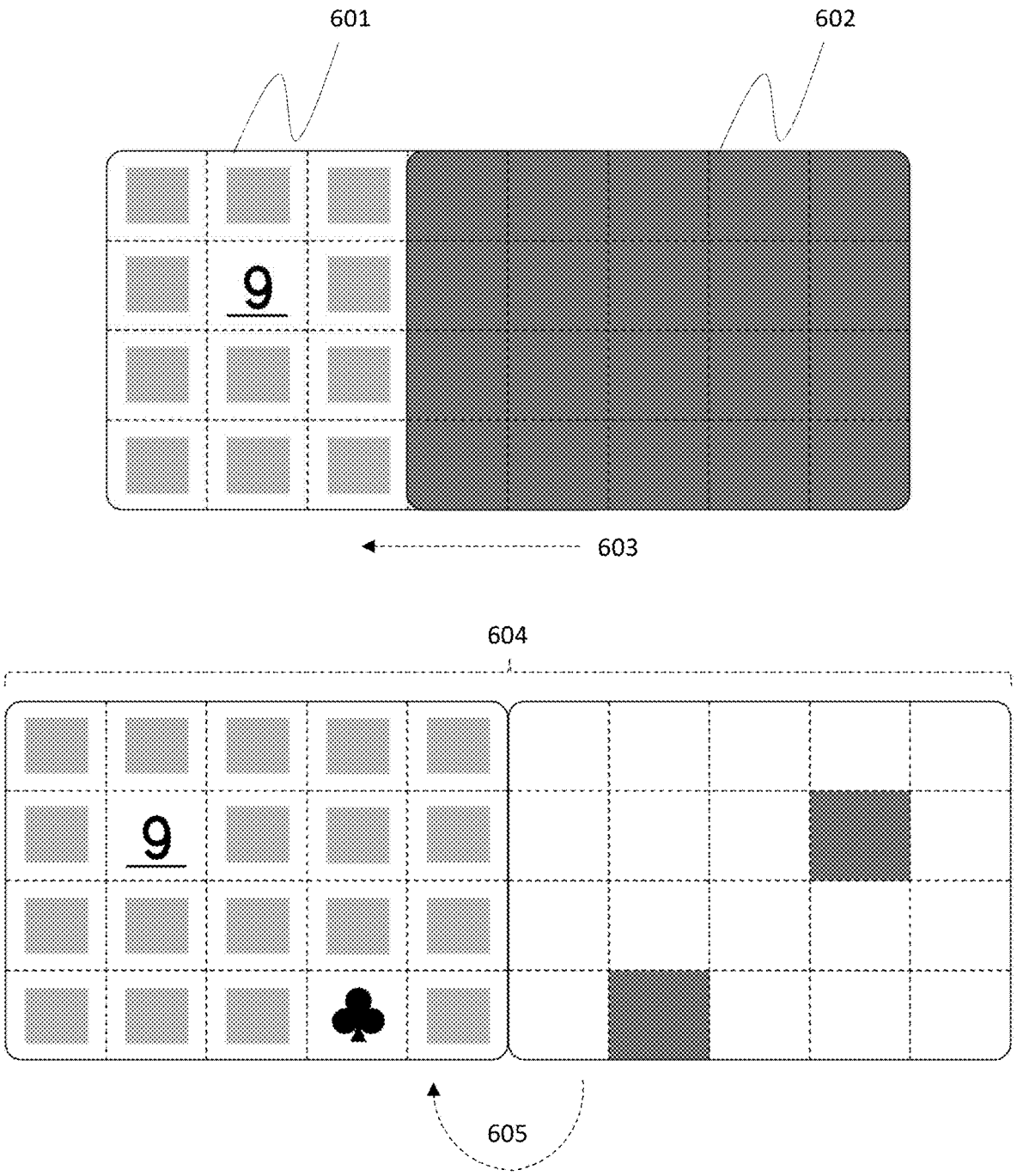
FIG. 6 shows the front face of the second card being moved into place with the rear face of the first card such that when pressed together, the two cards will now be seen as a single card with symbols on a front face and an entirely opaque-colored surface on a rear face. In another embodiment, a single card is divided into two halves, with one half selectively adhered and folded over to create the same single-card result.

FIG. 6 shows the first and second cards (601 and 602) could be discrete, initially, and the second card moved into position over the first card as shown (603). Alternatively, a single card (604) could be divided into two halves having the equivalent of the two discrete cards, with the selective opaque-colored half folded over the rear-side of the other half as shown (605). In either case, the completed prop system appears as a single card with a front and rear face.

Figure 7:
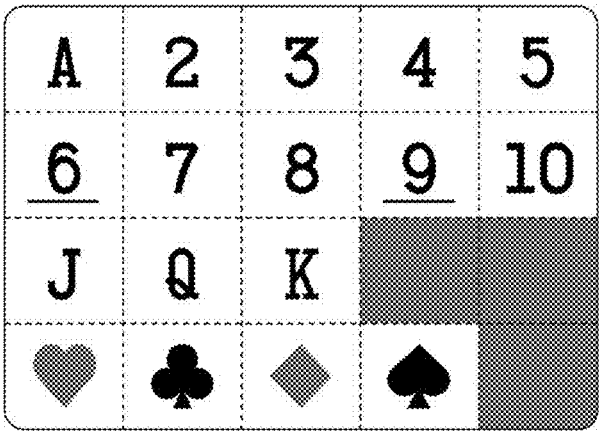
FIG. 7 shows the front and rear face of the resulting card once the adhering and pressing has been completed.
Figure 7:
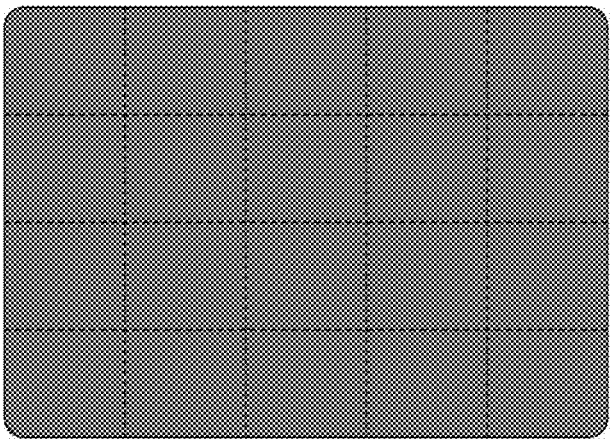

FIG. 7 shows the completed prop card's front and rear faces before being separated into discrete tabs.

Figure 8:
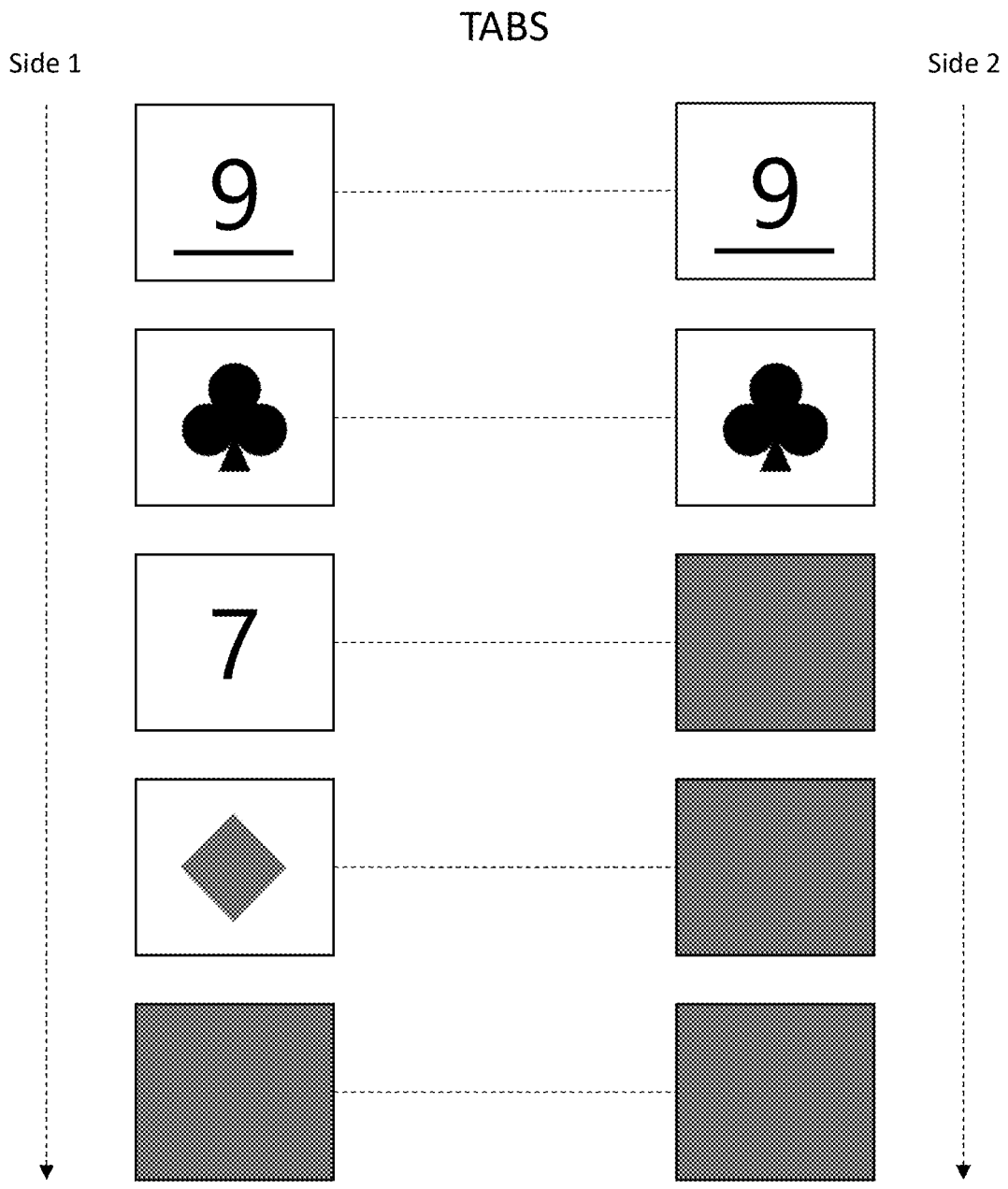
FIG. 8 shows that, after separating, only the predetermined forcing tabs will have identical symbols on both faces whereas all other tabs will have a symbol on one face and an opaque-colored surface on the opposite face, or opaque-colored surfaces on both faces.

FIG. 8 shows the results after the tabs are separated. As shown, the two predetermined forcing tabs—the symbol 9 and the suit symbol for a club—will have the same symbol displayed on the front and rear faces. Fifteen of the other tabs will have the remaining card and suit symbols on one face and opaque-colored surfaces on the opposite face. And, in this example, five tabs will have opaque-colored surfaces on both surfaces.

When separated into discrete tabs, then contained, shaken, and tossed onto a surface, all tabs having an opaque-colored face will ultimately flip and exhibit an opaque-colored face, and, thus, be eliminated using the prescribed procedure. Only two tabs cannot under any circumstance exhibit an opaque-colored surface—the tabs with the symbol 9 and the suit symbol for a club.

These descriptions and drawings are exemplary. The cards may be divided into different row/column arrangements, and the symbols chosen could be any set of unique alphanumeric or other symbols. There can be any number of predetermined forcing tabs, and the predetermined forcing tabs can be located in any position throughout the card. The card and tabs can be any shape and size. The principle is the same. The predetermined forcing tabs will not be adhered to an opaque-colored surface whereas all other tabs will be adhered to an opaque-colored surface—so that during shaking, tossing, and eliminating, only the predetermined forcing tabs will remain due to identical symbols on each face.

The cards, as illustrated, show dotted line portion demarcations. These could be perforations or scoring that makes it easy to separate the portions into discrete portions. These demarcations could alternatively be printed on the card indicating where to tear or cut with scissors.

What is claimed is:

1. A forcing magic-trick prop comprising:

two same-size cards equally divided into tabs;

a first card with unique symbols and opaque-colored surfaces on the front face;

the first card has one or more symbols on selected tabs on the rear face that are identical to the same tab's symbol on the front face called the predetermined forcing tabs;

a second card has tabs with opaque-colored surfaces on the front face that correspond with the location of the predetermined forcing tabs on the first card's front face;

the second card is entirely opaque colored on the rear face;

the rear face of the first card is selectively coated with adhesive on all tabs except for the one or more predetermined forcing tabs;

the rear face of the first card is positioned over the front face of the second card so that their edges line up exactly;

the first card and second card are pressed together such that they adhere to one another producing a single card that displays the front face of the first card and the rear face of the second card; and the first card and the second card are scored or perforated along the borders of each tab to enable easy separating of the tabs.

2. A method of use for the forcing magic-trick prop as claimed in claim 1, comprising:

a. separating the tabs into several discrete tabs;

b. placing separated tabs into a container;

c. spilling the separated tabs onto a flat surface;

d. removing any of the separated tabs whose exposed face has an opaque color;

e. keeping any of the separated tabs whose exposed face has a unique symbol; and continuing steps b-d until only a predetermined number of tabs having no opaque-colored surfaces remain.

* * * * *